US007077397B2

(12) United States Patent
Stevens

(10) Patent No.: US 7,077,397 B2
(45) Date of Patent: Jul. 18, 2006

(54) HIGH CAPACITY DOCUMENT SHEET PROCESSOR

(75) Inventor: Kenneth A. Stevens, Batavia, IL (US)

(73) Assignee: EMC Document Technologies, Inc., Batavia, IL (US)

( * ) Notice: Subject to any disclaimer, the term of this patent is extended or adjusted under 35 U.S.C. 154(b) by 0 days.

(21) Appl. No.: 10/689,899

(22) Filed: Oct. 21, 2003

(65) Prior Publication Data

US 2005/0082736 A1 Apr. 21, 2005

(51) Int. Cl.
*B65H 1/02* (2006.01)

(52) U.S. Cl. ..... 271/149; 271/150

(58) Field of Classification Search ..... 271/9.01, 271/9.13, 10.07, 34, 149, 150
See application file for complete search history.

(56) References Cited

U.S. PATENT DOCUMENTS

| | | | | |
|---|---|---|---|---|
| 4,928,944 | A * | 5/1990 | Golicz | 271/6 |
| 6,467,764 | B1 * | 10/2002 | Stevens | 271/4.01 |
| 6,533,261 | B1 * | 3/2003 | Katou et al. | 271/3.12 |
| 2002/0014736 | A1 * | 2/2002 | Katou et al. | 271/126 |
| 2003/0025266 | A1 * | 2/2003 | Stevens | 271/149 |
| 2003/0189280 | A1 * | 10/2003 | Stevens | 270/58.01 |

FOREIGN PATENT DOCUMENTS

EP 0375146 * 6/1990

* cited by examiner

*Primary Examiner*—Kathy Matecki
*Assistant Examiner*—Thomas Morrison
(74) *Attorney, Agent, or Firm*—Barnes & Thornburg LLP; Glenn W. Ohlson

(57) ABSTRACT

A high capacity document sheet processor combines significant speed and efficiency enhancing improvements in existing approaches to stack feeding particularly in the stack loading, feeding and singulating functions with novel operational arrangements adaptable to a universal paper handling and envelope inserting system.

1 Claim, 17 Drawing Sheets

HIGH CAPACITY DOCUMENT SHEET PROCESSOR

BACKGROUND

FIELD OF THE INVENTION

A need exists to accurately and quickly feed stacks of paper to high speed envelope inserting machinery, particularly the type known generically as the 'Phillipsburg' type, for sheet feeding devices that handle a wide variety of physical forms and can combine different forms for ease of operation, reduced operator intervention and improved reliability. The disclosed sheet processor feeds stacked, precut forms, provided in sequential for placing in an inserter stream using a slanted table, a generally vertical wall and optimized feed and singulator mechanisms. The disclosed sheet processor is adapted to direct feeding into an envelope inserter, or for inclusion in a continuous feed format handling device.

SUMMARY OF THE DISCLOSURE

The disclosed sheet processor uses paper vertically stacked on a feed table positioned against a top-edge guide assembly spacing the paper stack from a vertical deck and separates the lead documents from the stack. Creeper belts feed the paper to the singulator device. Precise control over the movement of the belts enables a precise feed to the singulator assembly, which combines dimensional and directional control of the paper leading edge to optimize speed and accuracy. Among the many features of and operations enabled by the disclosure are the abilities to reverse creeper belts, control creeper belts as to speed and timing, auto-advance a singulator, enable manual document feeding without system reset, provide a tilt back feature enabling maintenance and jam clearing, and the ability to receive auxiliary input and dual input and feeding paper by taking advantage of upper edge paper guides.

BRIEF DESCRIPTION OF THE DRAWINGS

The following drawings, in which like reference characters indicate like parts, are illustrative of exemplary embodiments of the disclosed sheet processor and are not intended to limit the scope of the disclosure thereof in any manner whatsoever, as encompassed by the claims forming a part hereof.

DESCRIPTION OF THE DRAWINGS

Figure 1:
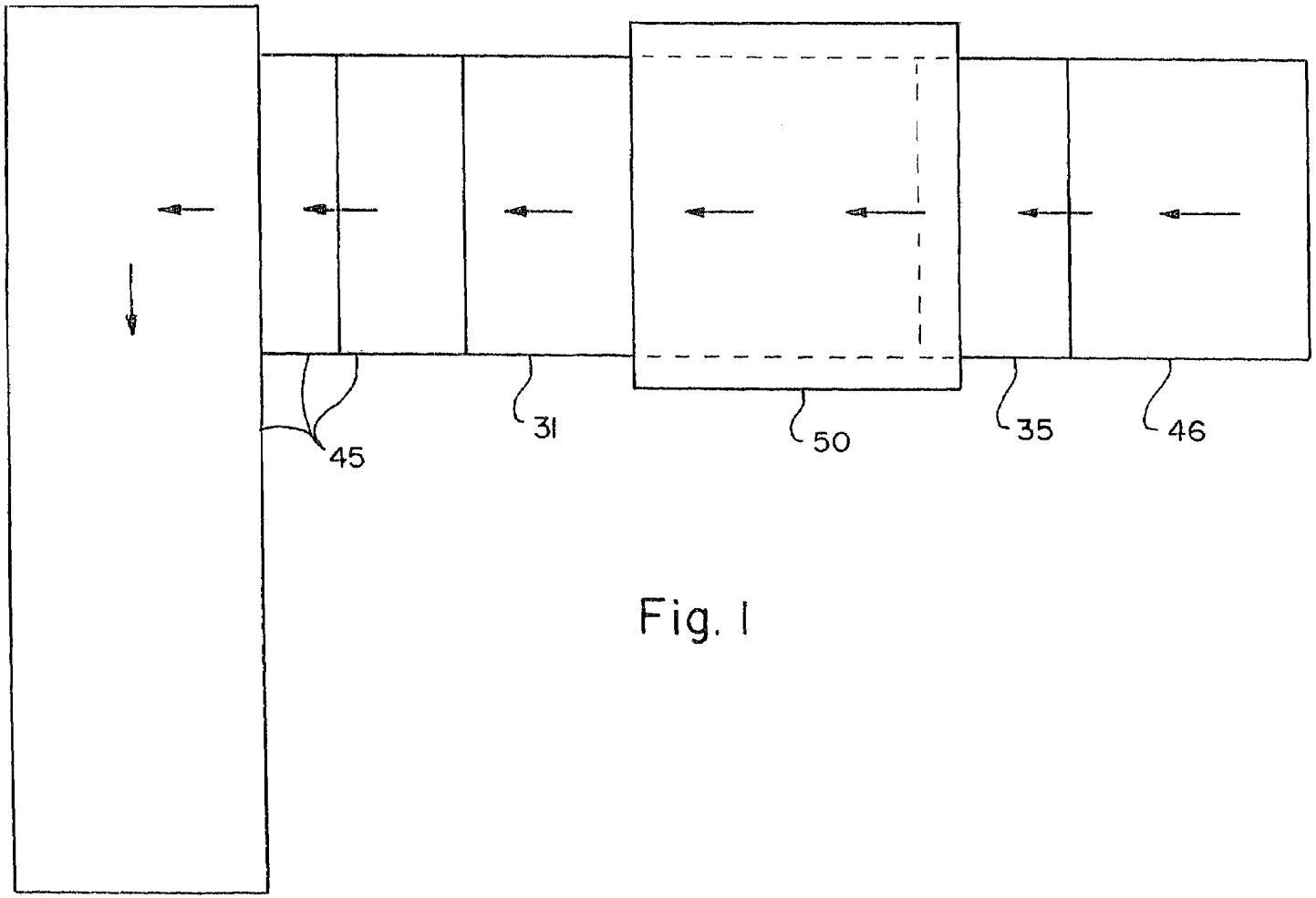

FIG. 1 is a block diagram showing the operation of the disclosed high capacity document sheet processor.

Figure 2:
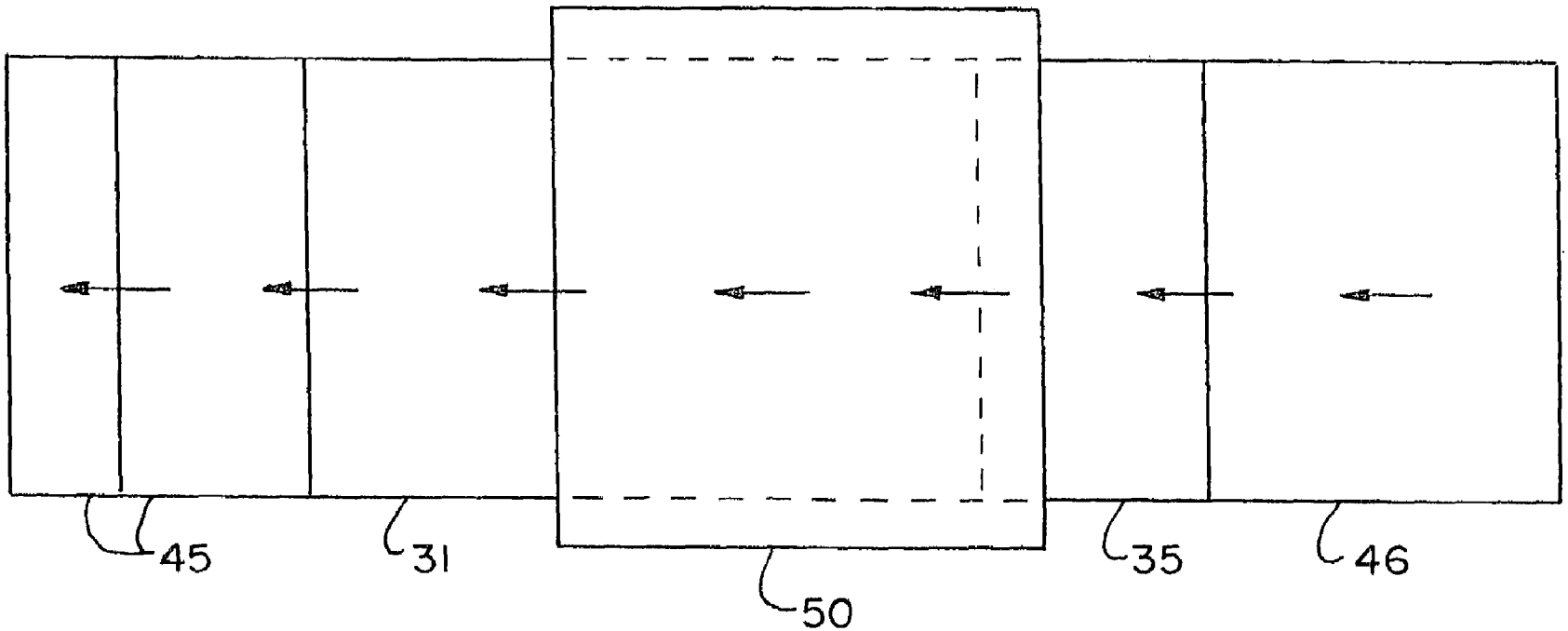

FIG. 2 is a block diagram showing an alternative embodiment of the disclosure with alternative downstream devices.

Figure 3:
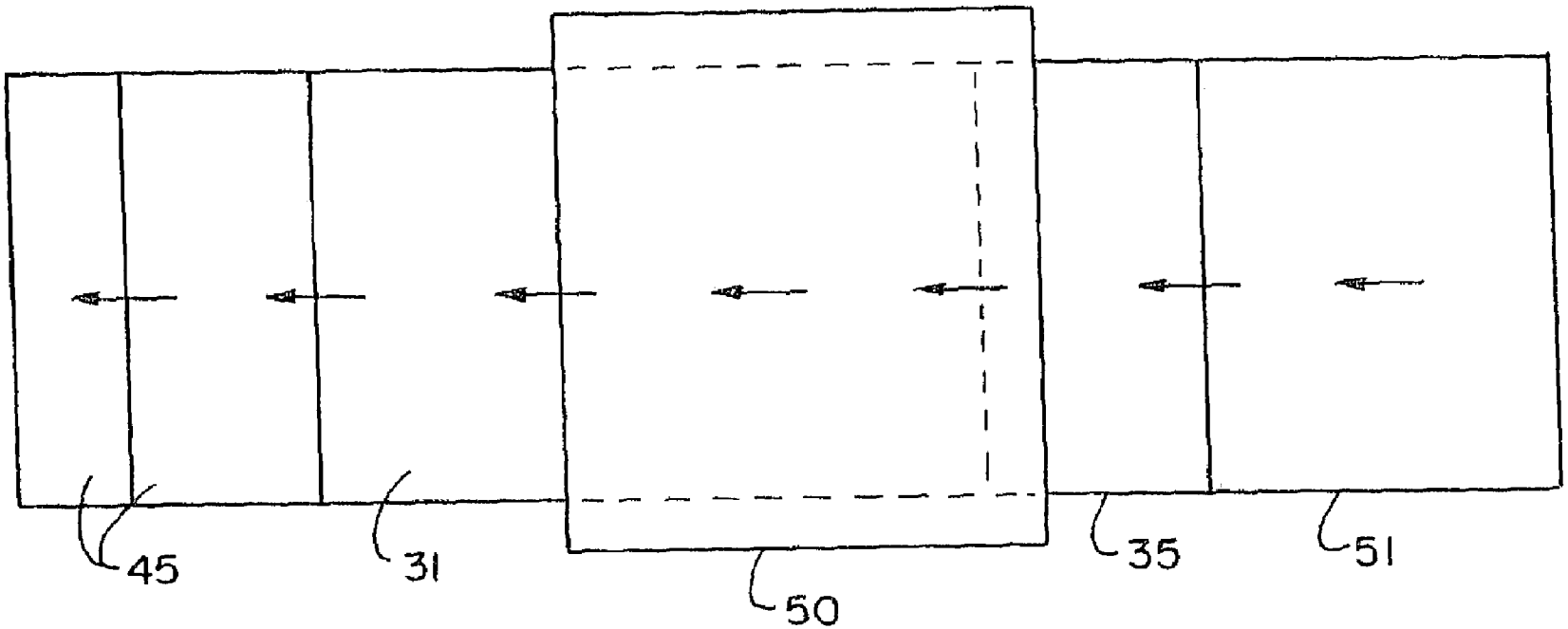

FIG. 3 is a block diagram showing another alternative embodiment of the disclosure with an auxiliary input and auxiliary downstream device.

Figure 4:
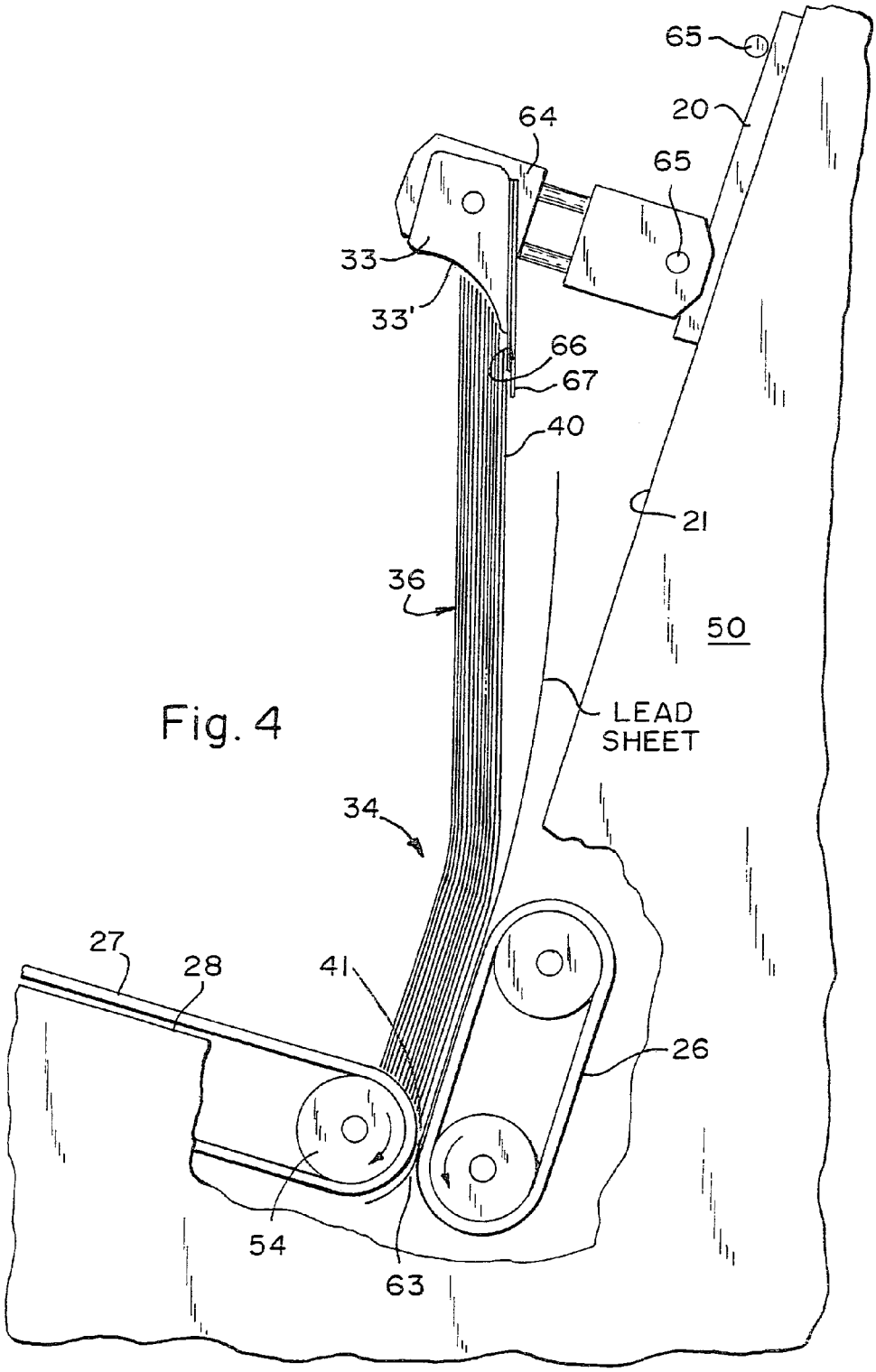

FIG. 4 is an elevational view of an upper edge paper guide and a portion of a singulator assembly of the disclosed sheet processor.

Figure 5:
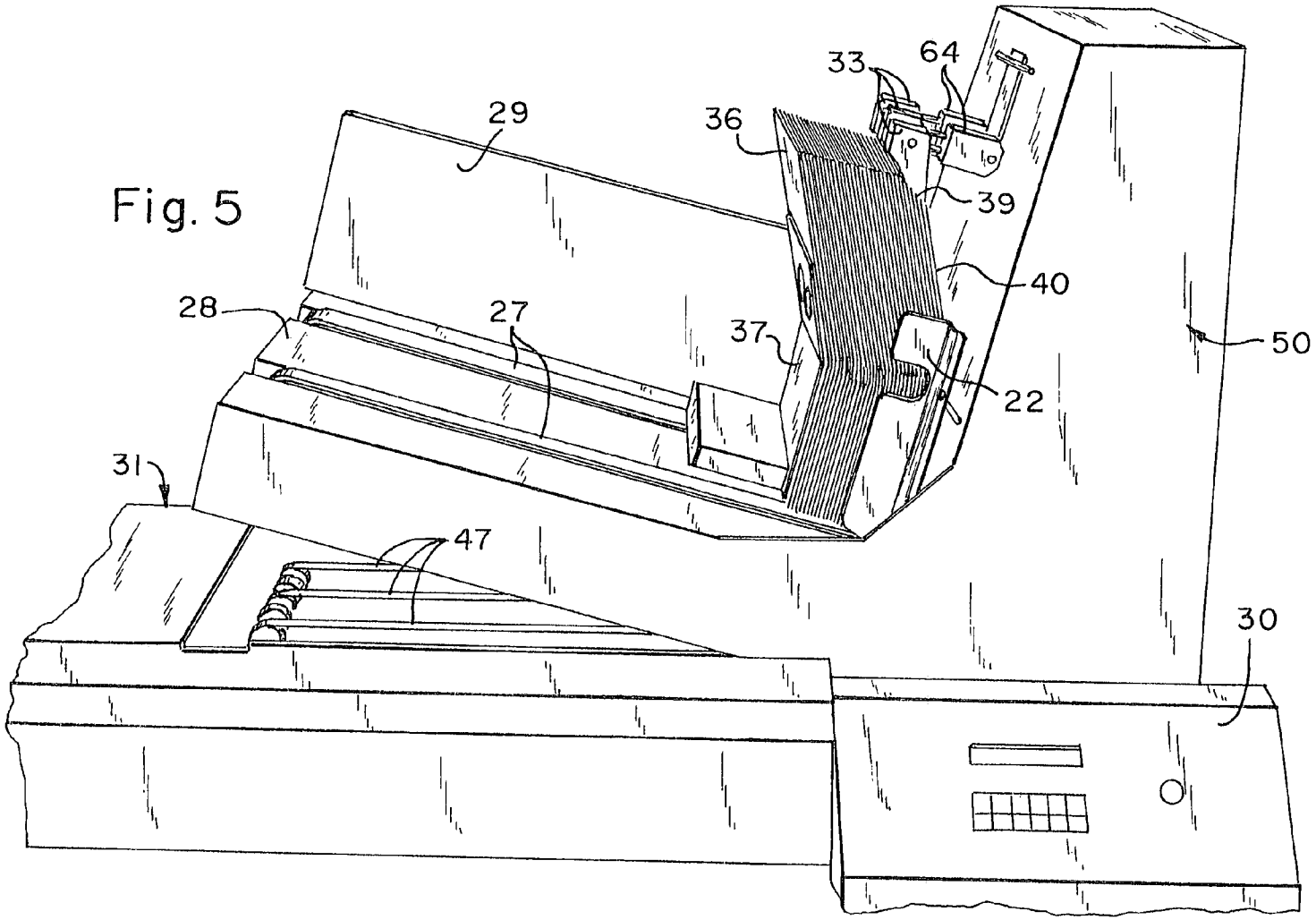

FIG. 5 is an elevational view of the disclosed sheet processor with a feed table in the operational position and a paper stack in position.

Figure 6:
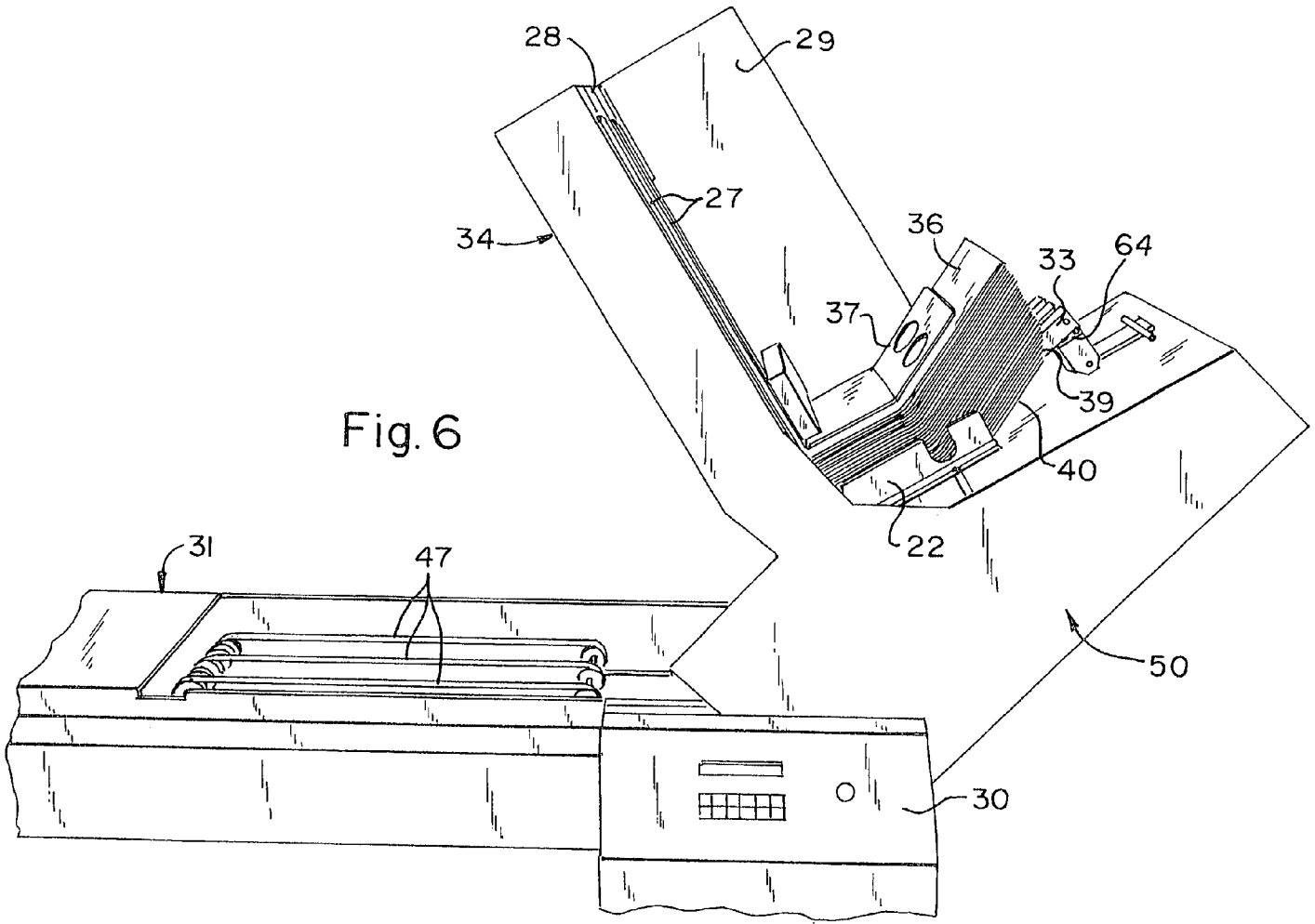

FIG. 6 is an elevational view of the disclosed sheet processor invention with a feed table tilted back and a paper stack in position.

Figure 7:
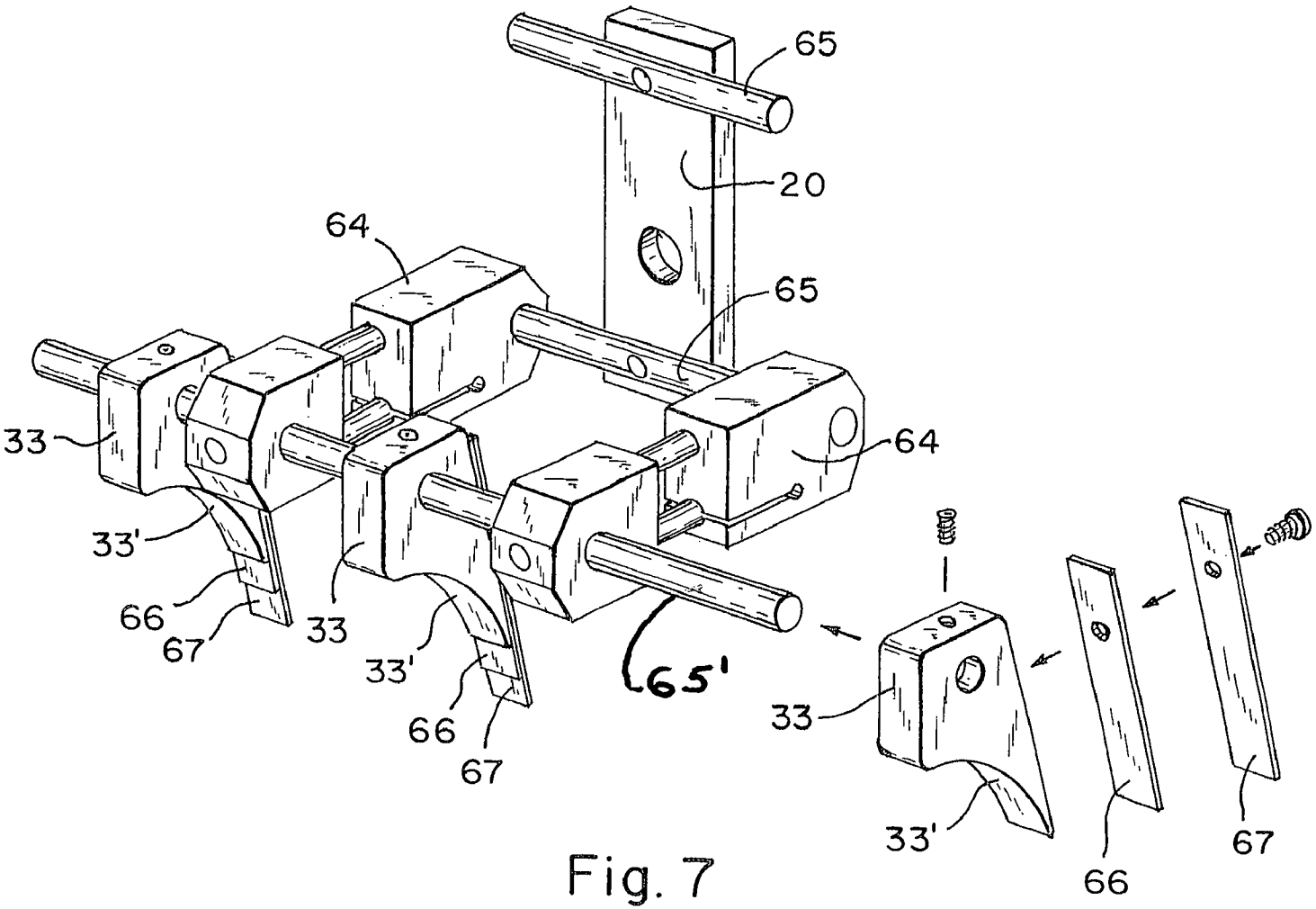

FIG. 7 is an exploded view of the upper edge paper guide assembly of FIG. 4.

Figure 8:
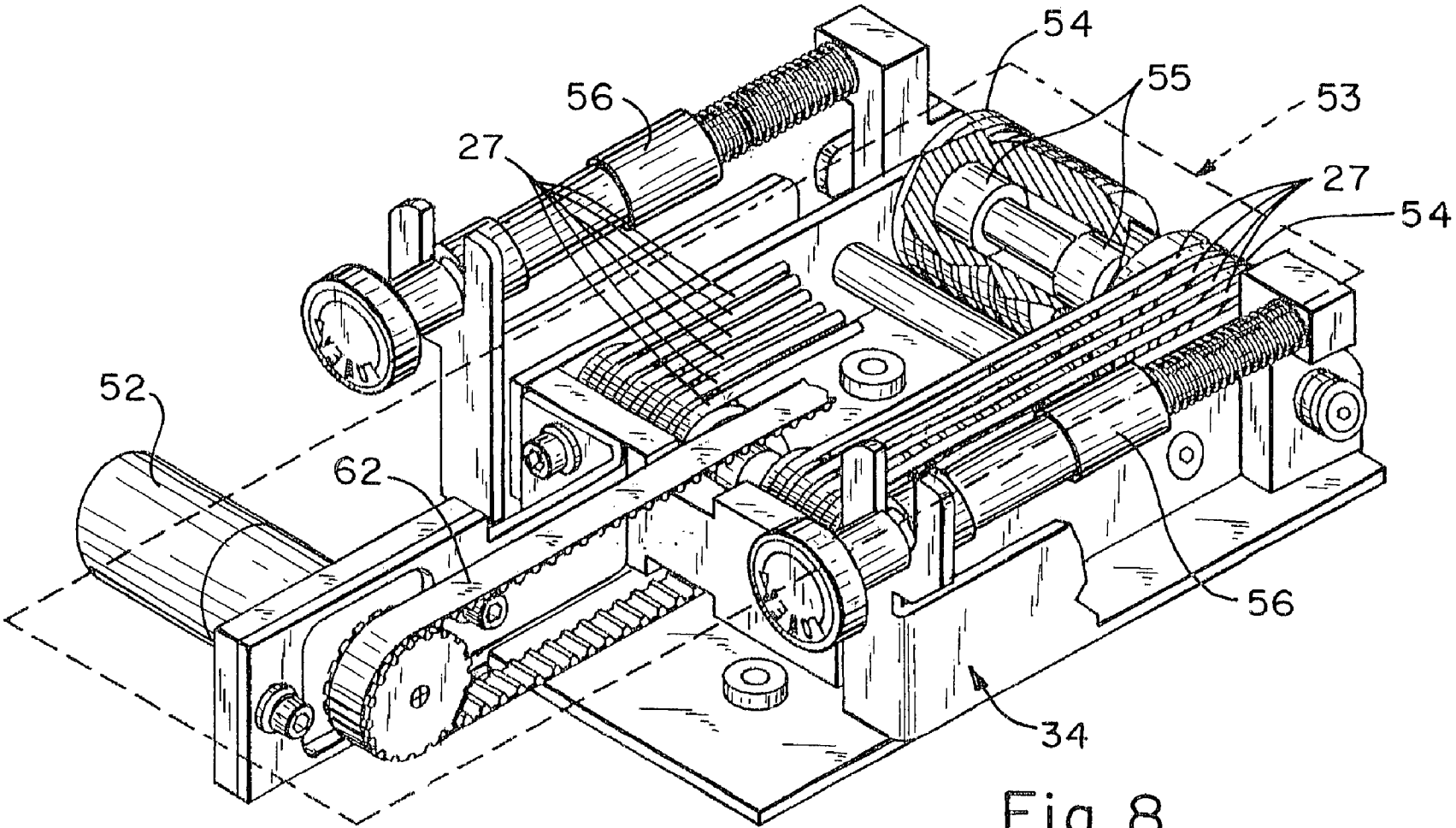

FIG. 8 is a perspective view of drive mechanisms for a singulator assembly of the disclosed sheet processor.

Figure 9:
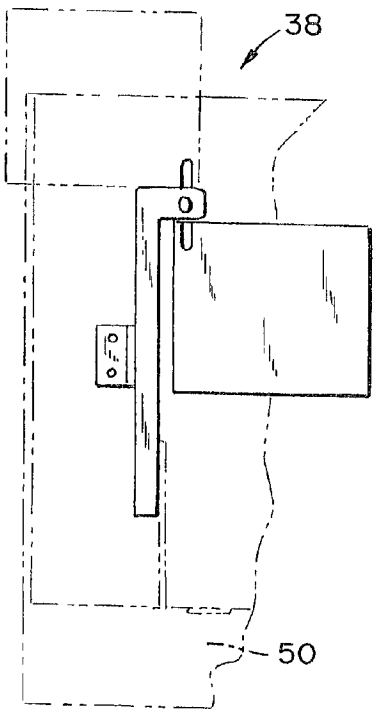

FIG. 9 is a rear elevational view of a paper stack support of the disclosed sheet processor.

Figure 10:
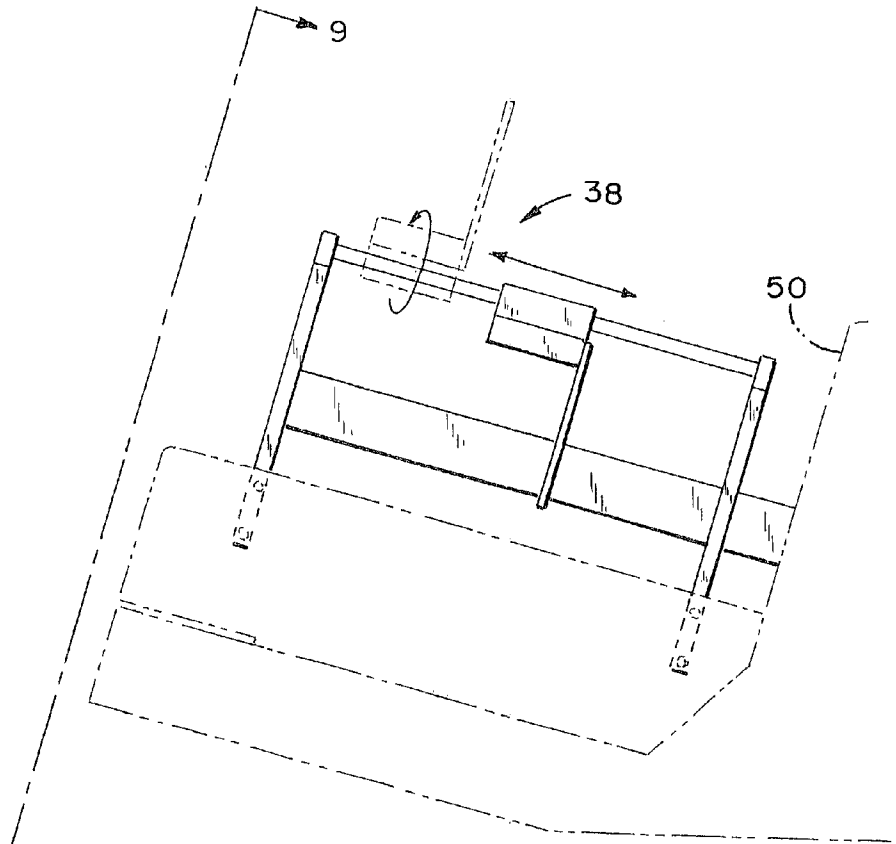

FIG. 10 is a side elevational view of a paper stack support of the disclosed sheet processor.

Figure 11:
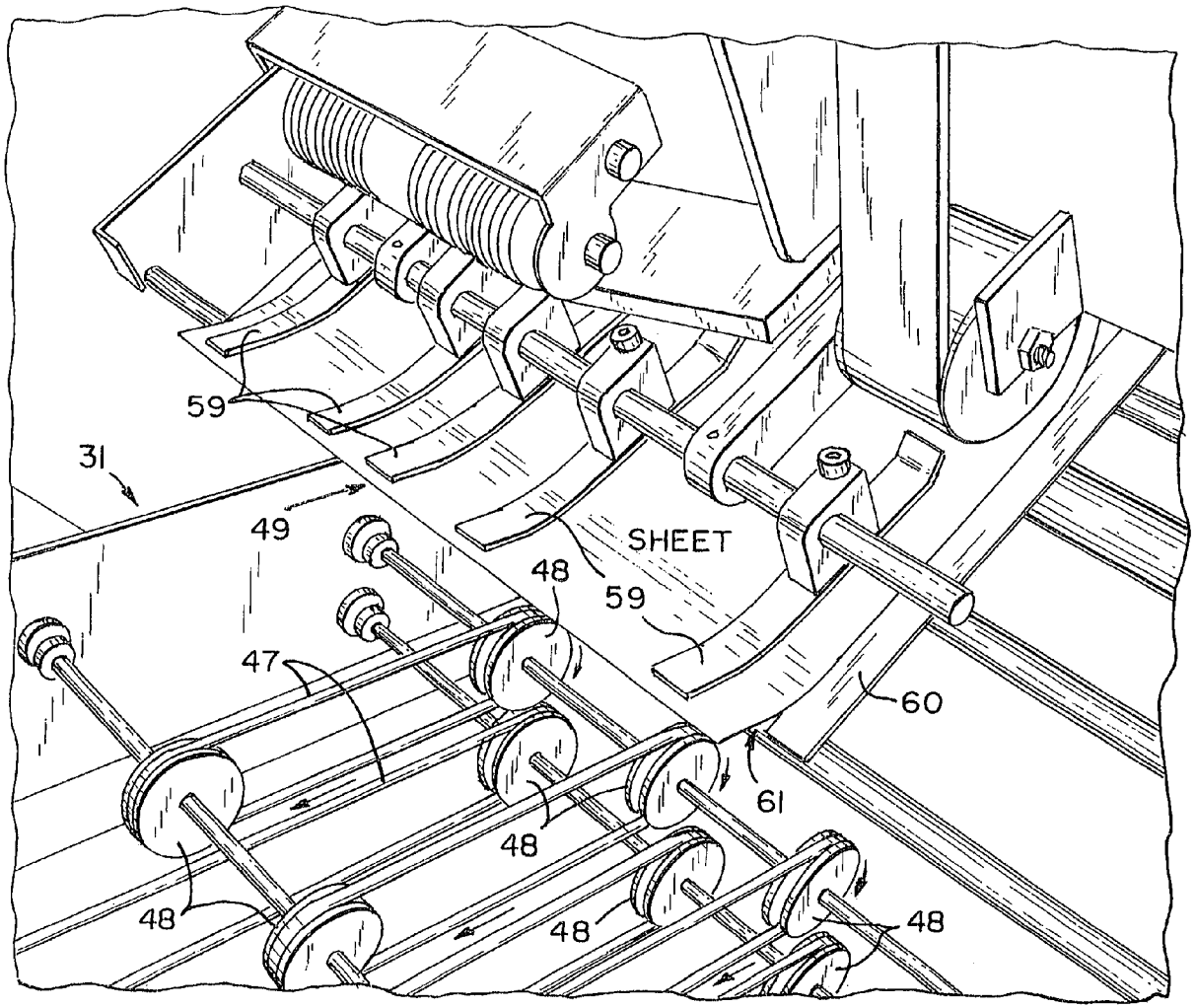

FIG. 11 is a perspective view of the disclosed sheet processor in an inoperative tilted-back orientation and showing transport ramps and paper path leaving the singulator assembly of FIG. 8 with directional arrows showing the subsequent path between the transport rollers when in the operative position.

Figure 12:
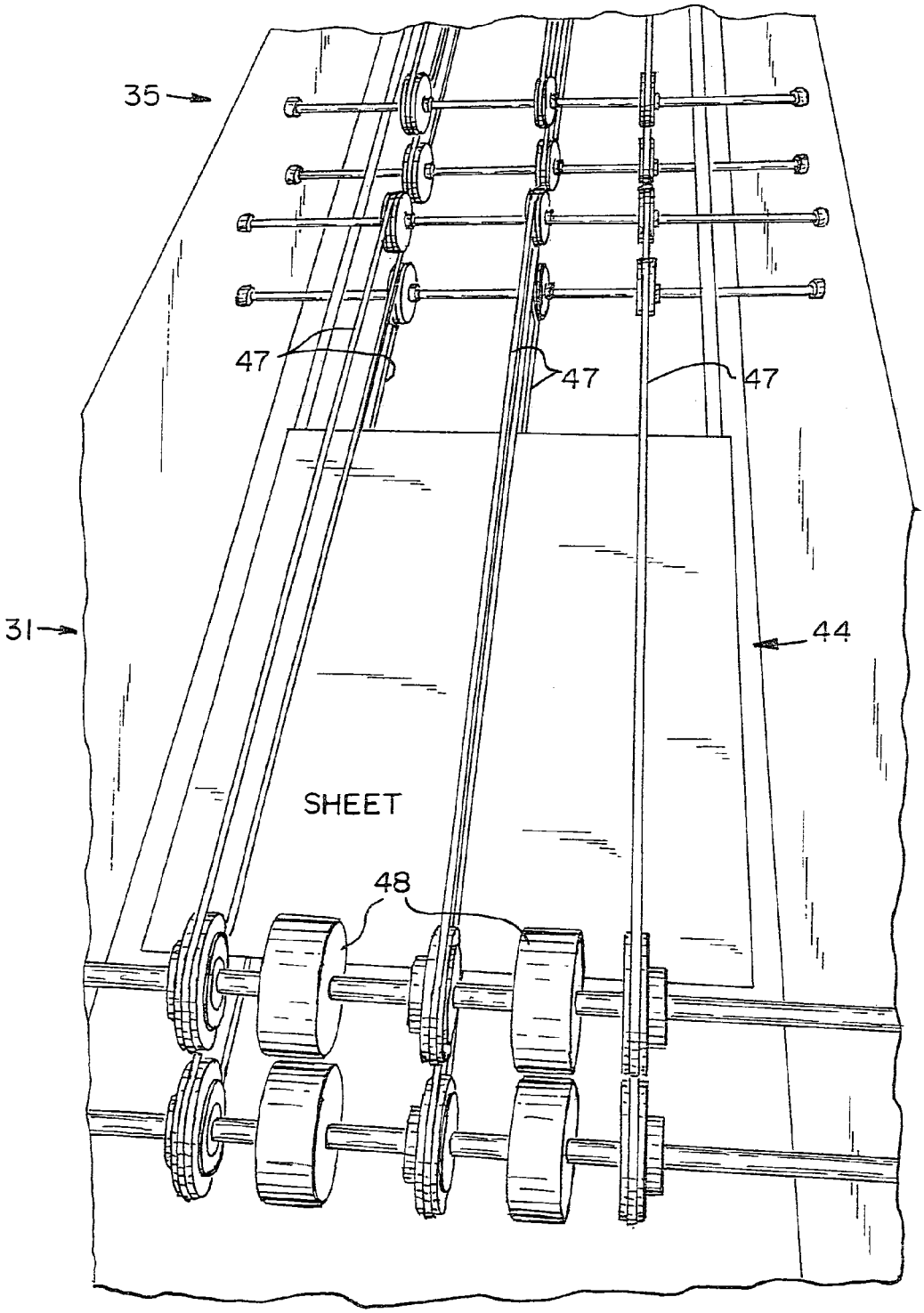

FIG. 12 is a perspective view of the paper path in the transport with a sheet passing therethrough.

Figure 13:
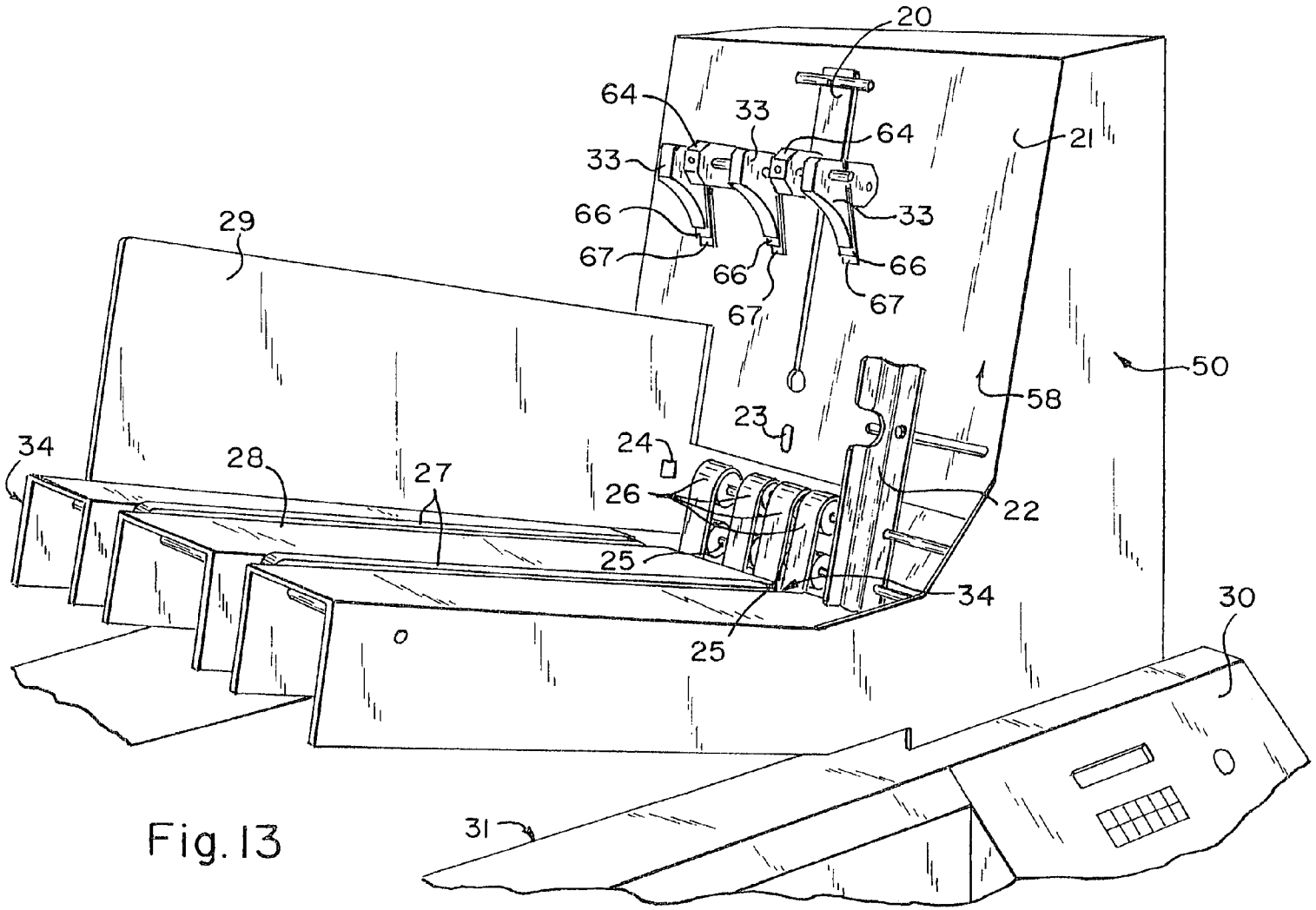

FIG. 13 is a perspective view of the feed table of FIG. 5, the singulator assembly entry aperture from the feed table, side sheet guides and an upper edge paper guide assembly.

Figure 14:
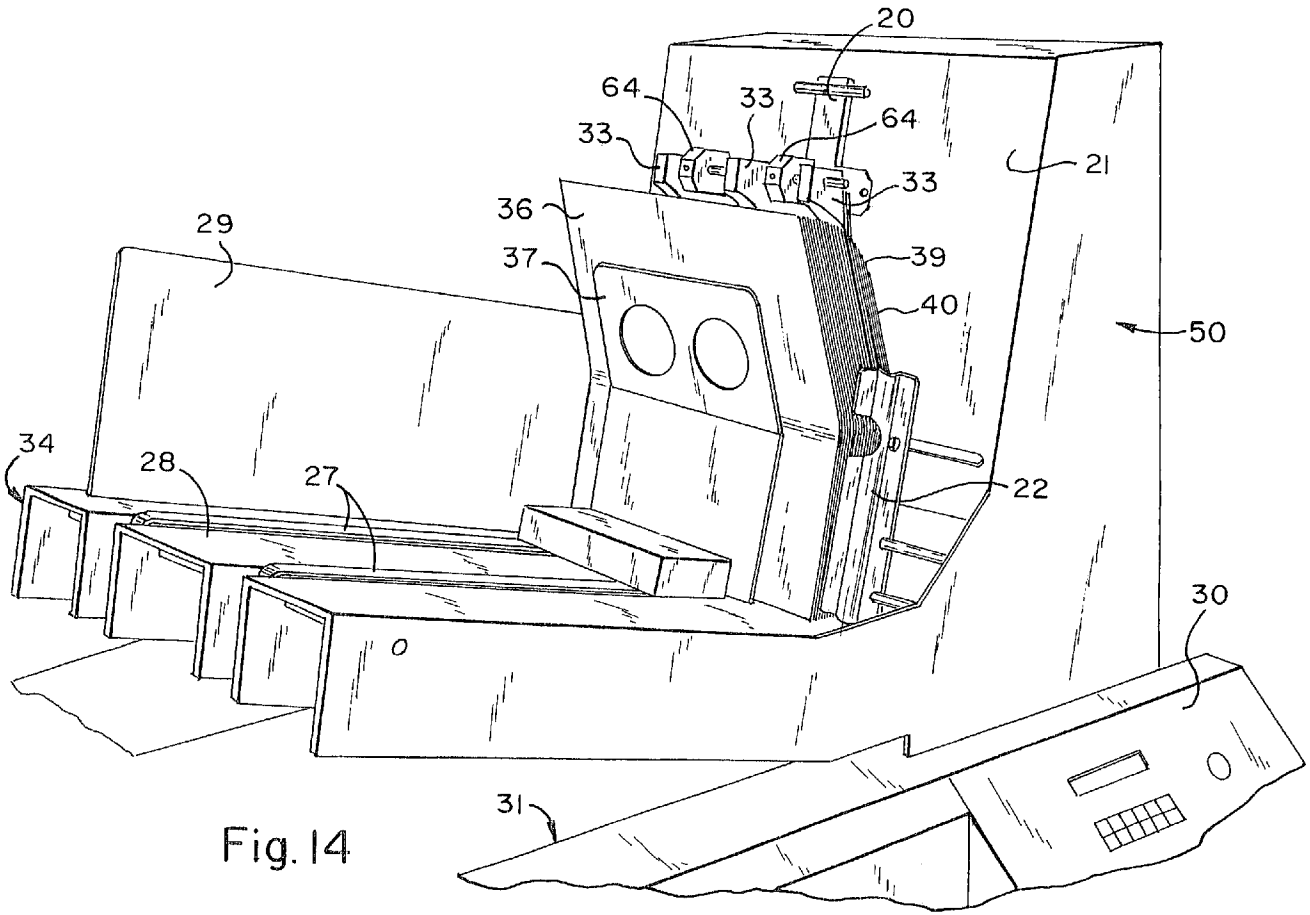

FIG. 14 is a perspective view of a loaded stack of paper sheets in position on the feed table.

Figure 15:
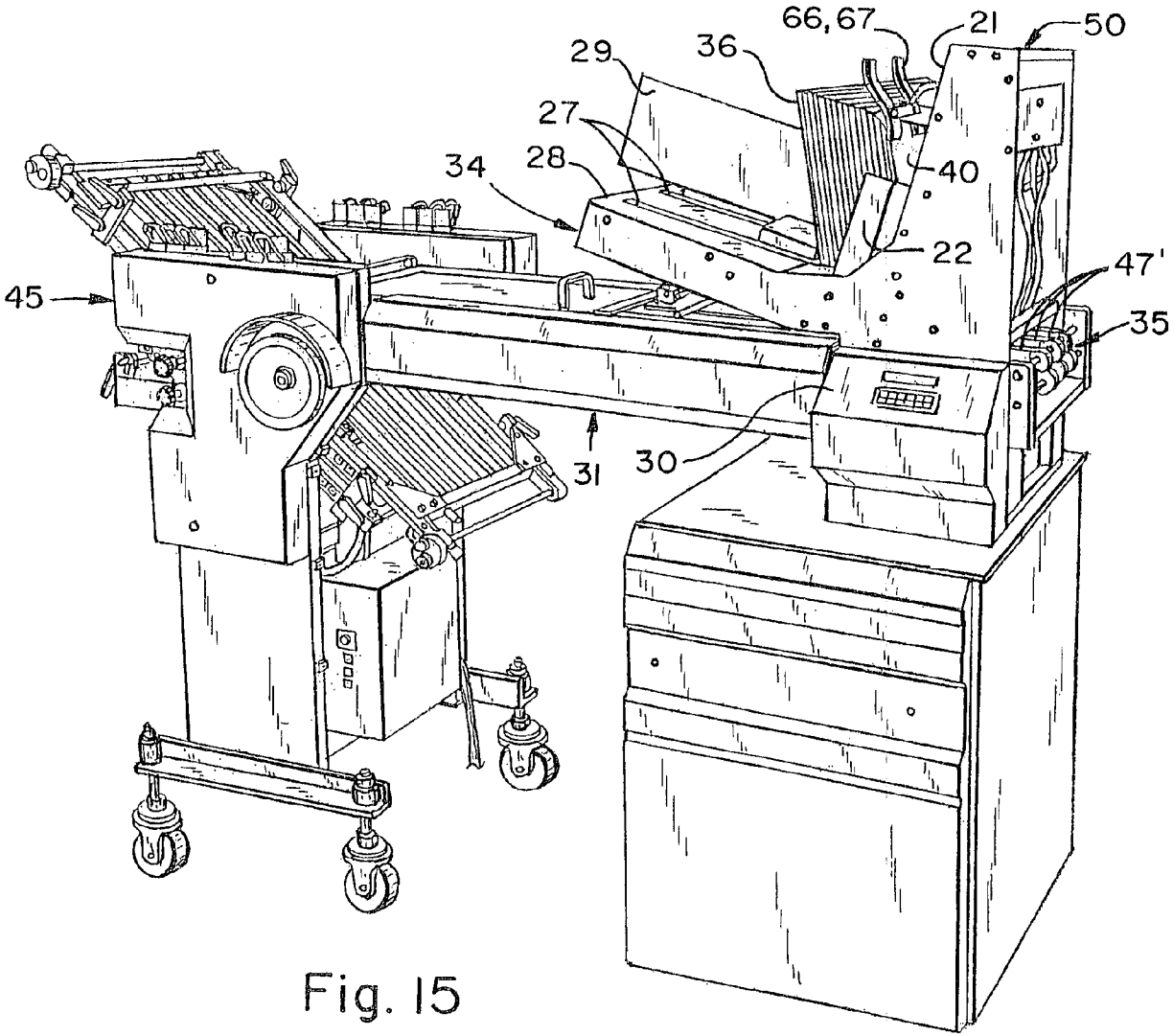

FIG. 15 is a perspective view of the disclosed high capacity sheet processor, having an alternate dual input transport, central processing unit control station and a downstream device.

Figure 16:
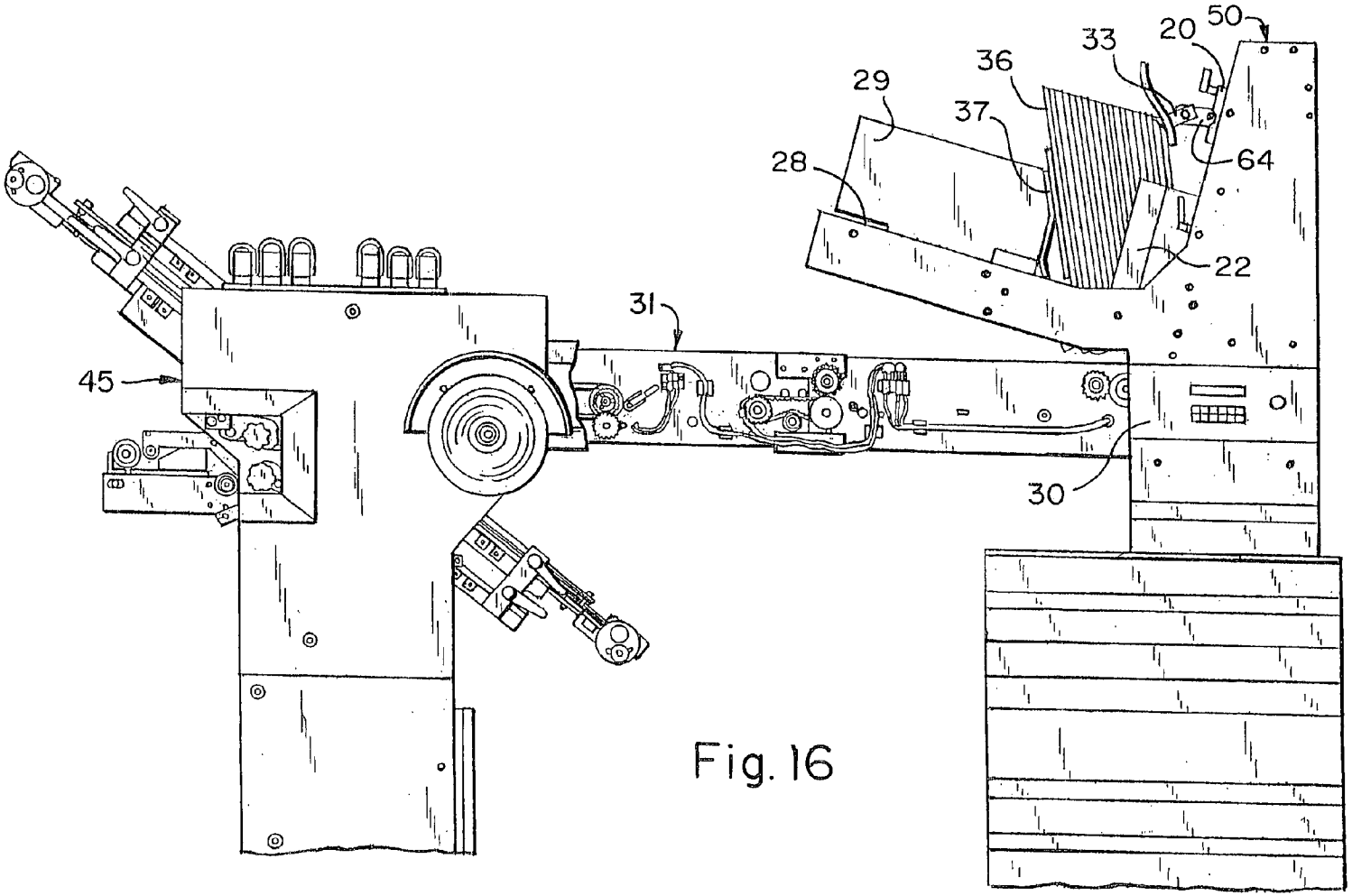

FIG. 16 is a side elevational view of the apparatus of FIG. 15.

Figure 17:
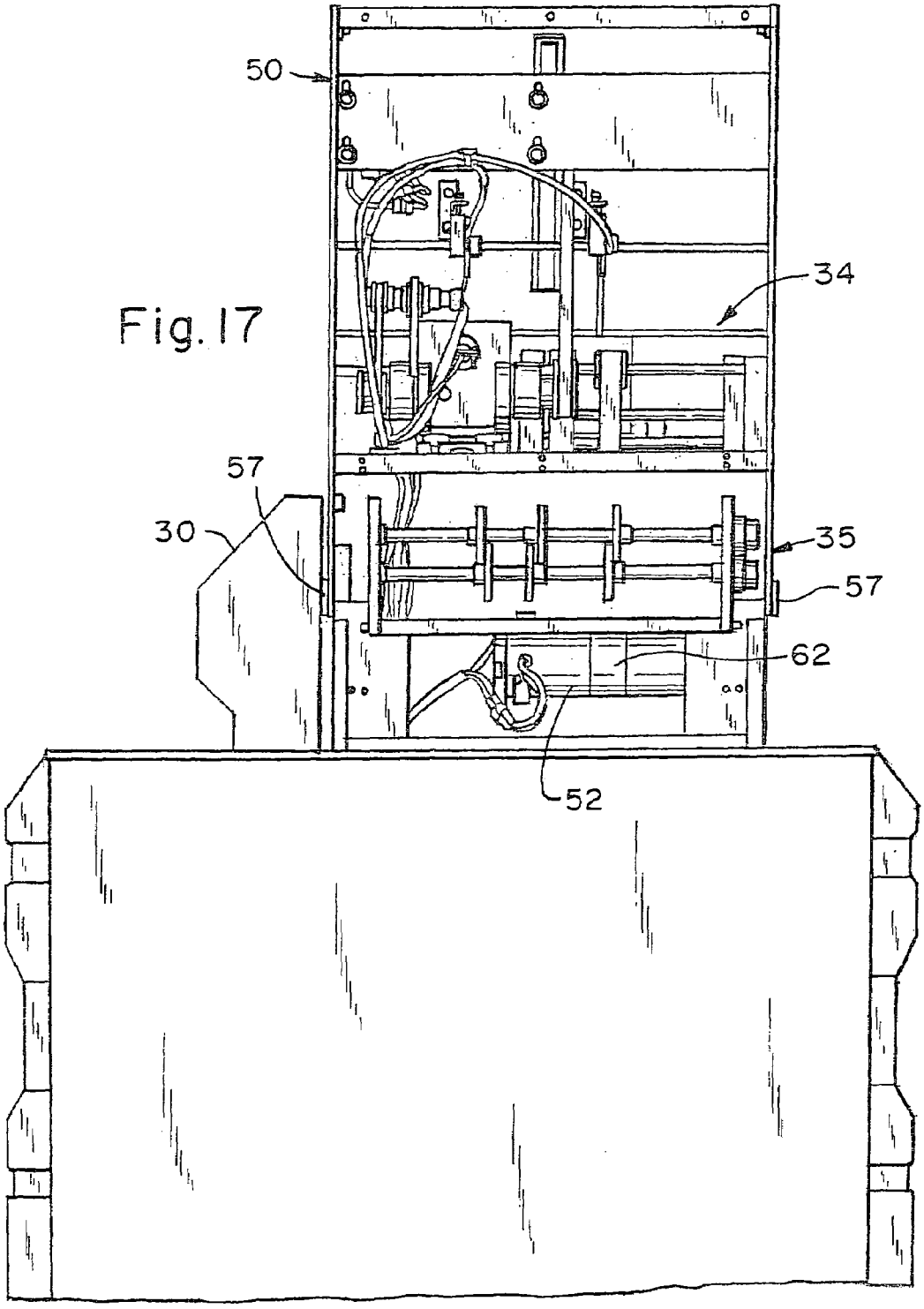

FIG. 17 is a rear elevational view of the apparatus of FIG. 15.

Figure 18:
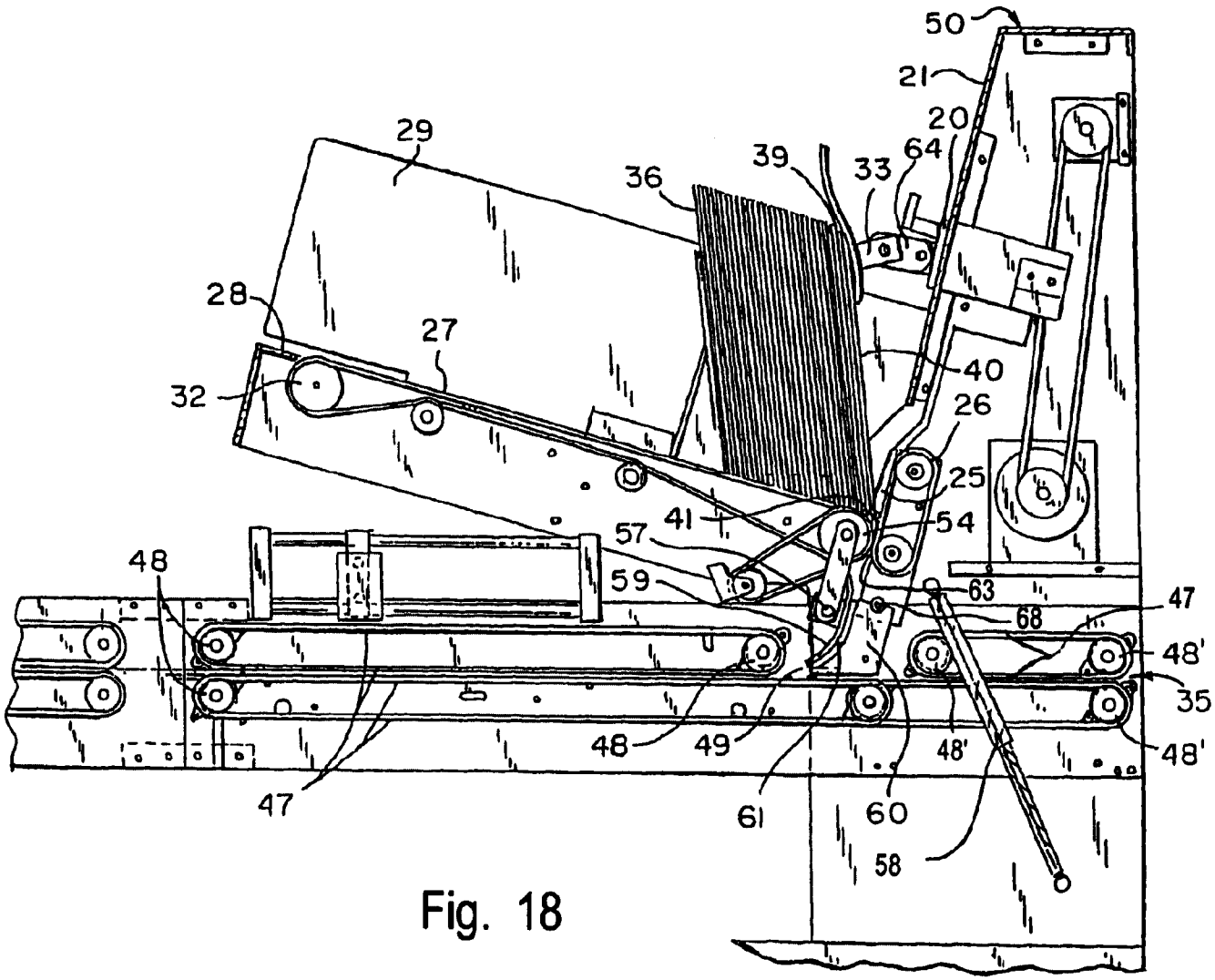

FIG. 18 is a side view of the apparatus of FIG. 15.

DETAILED DESCRIPTION

The disclosed high capacity document sheet processor 50 provides for feeding single sheets of paper from 8.5"×11" up to 11"×17" in size, and paper weights from 16 lbs. to 60 lbs. (+/−) stock with variable intermixed weights from 16 lbs. to 60 lbs. Stock (+/−). The paper is vertically stacked on a feed table (28) of the sheet processor 50 and the rear of a paper stack (36) is held in position during loading with the assistance of a positional paper stack support (38). Once the sheet feeder 50 is loaded, which can involve loading typically up to about 4,000 sheets, the positional paper stack support (38) is raised to the home position and replaced with a vertical stack support (37) to support the rear of the paper stack (36). The upper-edge guide assembly (FIG. 7) holds the top-front (39) of the paper stack (36) in position. The upper-edge guide assembly (FIG. 7) keeps the entire paper stack (36) away from a vertical deck (21) of the sheet feeder 50, and separates lead documents (40) from the paper stack (36) maintaining consistent vertical positioning as the documents are fed into a singulator assembly (34). Two timing belts (hereafter referred to as creeper belts) (27) carry the paper to the singulator device (34) via two D.C. driven gear motors (32)(FIG. 18). The gear motors (32) can be independently or simultaneously controlled, depending on the application, to keep even pressure on feed belts (26) and are reversible in conjunction with the singulator (34) to remove jams and loaded paper. Left and right hand electronic or electromechanical switches (25) between the feed belts (26) sense the paper stack (36) pressure sending a signal to a CPU (30) which advances the left and right creeper belts (27) for a predetermined degree of time and/or a predetermined number of pages.

The paper is then fed via feed belts (26) through the singulator assembly (34) comprising said feed belts (26) and stationary rollers (54) (FIG. 8)(stationary rollers hereafter refers to a plurality of round belting or a solid composite material around a cylindrical core). The singulator assembly (34) is adjustable and has two adjustable tension settings (56) to assure that multiple sheets will not be allowed to pass together (FIG. 8). In the exemplary embodiment of the singulator assembly (34) said plurality of stationary rollers (54) are rotated by a D.C. gear motor (52) and are indexed to compensate for belt wear.

A sensor (24) (FIG. 13) is provided for sensing a low paper condition and alerting the operator of the low paper condition. Without this sensor (24) when the sheet feeder empties, a new start up process would be needed, which would slow production. A feeder empty sensor (23) is provided to alert the operator that: (a) an end-of-job condition exists, wherein the operator would then put the feeder into an end-of-job mode and continue processing the remaining documents, (b) the feeder would automatically proceed into an end-of-job mode and continue processing the remaining documents, or (c) an out-of-paper condition exists, whereby the operator would reload paper into the feeder 50 and enter a begin job mode.

The paper is transported from the feed table (28) to a transport (31) between a set of positioning side guides (22 and 29) (FIG. 15) and continues through a controlled paper path gap (61) (FIG. 11) comprising of a plurality of transport ramps (60) and spring loaded guides (59), which capture and control the paper sheets while in transit. The spring loaded guides (59) maintain the gap (61) to be even for controlling the moving paper sheets to the transport ramp (60). Accessibility to the paper path gap (61) is provided by raising the spring-loaded guides (59) up for clearing paper jams and servicing. Because the guides (59) are spring-loaded and adjusted by adjustable positioning screws (68) they will return to their original position with relation to the transport ramps (60). The paper is held in the transport (31) until the CPU (30) calls for another piece to be fed from the feed table (28). The CPU (30) can be set to a predetermined page quantity (a set) either directly by the user or automatically via an integrated OMR, BCR or OCR reading system (optical mark recognition; bar code recognition; optical character recognition; respectively). A page set can be either single-page or multiple pages. When the transport device (31) is emptied into a downstream device (45), which may comprises in the exemplary embodiment to be a folder, as shown (FIG. 16), the next piece is fed from the feeder (50) into the transport (31)(FIG. 3). In another embodiment, the device (45) may be an accumulator, or other devices known to those skilled in the art of mail inserting devices. This process continues until the pre-determined page set (quantity) is reached. In one alternate mode of operation, the transport (31) holds the first page of a set waiting for the subsequent pages for that set to be delivered to the transport (31) and accumulated. Once the accumulated set is complete it is delivered to the downstream device (45).

An auxiliary input (35) (FIGS. 15 and 18) having transport belts (47') driven by rollers (48') of the transport (31) is designed to optionally accept documents from another upstream device (46) (FIGS. 1 and 2), such as, but not limited to, any one of the following: a manual feed tray; a universal friction, or vacuum, sheet feeder; or, a 1-up or 2-up continuous forms processor. Documents (sheets) are fed from the upstream device (46) into the input of the transport (31) via round belts (47) (FIGS. 12 and 18) and held at transport dump rollers (48). The CPU (30) can be set to a predetermined page (sheet) quantity (a set) either directly by the user or automatically via an integrated OMR, BCR or OCR reading system. A page set can be either single-page or multiple pages. When accumulating in a downstream device, such as device (45), the transport (31) is emptied into the downstream device (45) and the CPU (30) simultaneously initiates the next document from the upstream device (46) to be fed into the transport (31). This process continues until the pre-determined page set (quantity) is reached. When accumulating in the transport (31), the transport (31) holds the first page of a set waiting for the subsequent pages for that set to be delivered to the transport (31) from the upstream device (46). Once the set is complete it is delivered to the downstream device (45).

A dual input capability is also disclosed. The transport (31) has two inputs, feeder input (49) of the feeder (50) and the alternate auxiliary input (35) of the upstream device (46) whereas documents from the feeder (50) and the upstream device (46) can be staged or merged in the transport (31). These inputs can be used integrally, allowing documents to be merged in the transport (31) or downstream device (45). Documents are fed from the feeder (50) or upstream device (46) into the input of the transport (31) via round belts (47) and held at the transport dump rollers (48) (FIG. 12). The CPU (30) can be set to a predetermined page quantity (a set) divided between sheet feeder and upstream device (46) either directly by the user or automatically via an integrated OMR, BCR or OCR reading system. A page set can be either single-page or multiple pages. When merging in the exemplary downstream device (45), the transport (31) empties the first page of a merging set into the downstream device (45) and the CPU (30) simultaneously initiates the next document in that set from either the upstream device (46) or feeder (50) to be fed into the transport (31). This process continues until the pre-determined page set (quantity) is reached in the down stream device (45). When merging in the transport (31), the transport (31) holds the first page of a merging set fed from either the feeder (50) or upstream device (46) waiting for the subsequent pages for that set to be delivered to the transport (31) from the feeder (50) or upstream device (46). Once the set is complete it is delivered to the downstream device (45).

The sheet feeder (50) has the ability to accept hand fed documents at its auxiliary input (35). A hand-feeding device located at (51), which in the exemplary embodiment discloses a tray, is illustrated as one alternate device. Via the CPU (30), the sheet feeder (50) may therefore be put into the hand feed manual mode. In this mode the feeder will accept documents one at a time manually fed or automatically fed via yet another auxiliary feed device (alternately located at 51), such as a friction feeder feeding into the transport (31) area and to the transport dump rollers (48). At this time, depending on the desired result, the document (sheet) can: a) be delivered directly to the down stream device (45), b) accumulate in either the transport (31) or the downstream device (45) by a predetermined set size or c) accumulate in either the transport (31) or the downstream device (45) under control of OMR, BCR or OCR. All of these alternate modes are useful in an in line inserting systems application, such as, in one system, where an operator might normally have to hand fold and stuff into an envelope. With either the predetermined set size, or one under control of OMR, BCR or OCR, the document can be delivered to an inserter system for manual or intelligent processing.

Reversing of the creeper belts (27) is synchronous with the reversing of the singulator (34) for removal of paper from the singulator aperture (41)(FIG. 4). This is necessary, such as, among other reasons, when removal of the entire paper stack (36) is needed or multiple pages are fed simultaneously into the singulator (34). To accomplish this, the D.C. gear motors (32) that drive the creeper belts (27), and the D.C. gear motor (52) for stationary rollers (54) incorporated in the singulator assembly (34), are operable to allow for reversing the direction of the paper stack (36) away from the singulator aperture (41).

Creeper belts (27) control is accomplished via the left and right hand electromechanical switches (25) and the CPU (30). The switches (25) sense the position of the paper stack (36) against the vertical deck (21) and the feed belts (26). When the stack position sensing switches (25) are in the open position, the CPU (30) calls for the creeper belts (27) to advance. Each stack position switch (25) works independently of the other but they advance the creeper belts (27) together. The creeper belt control is monitored and controlled by the CPU (30). The user can set a predefined quantity of pages to be fed between creeper belt (27) advances. After a user-defined page count is reached, the creeper belts (27) advance for a predetermined time or until the stack position switches (25) are both closed. If the stack position switches (25) are still open, the CPU (30) will instruct the creeper belt motors (32) to repeat the process. During the advancement, the creeper belts (27) are pulsed. This eliminates the chance for the electromechanical sensors (stack position switches) (25) to over compensate and advance too much paper to the feed belts (26) and singulator (34), which would result in uneven pressure at the feed belts (26).

A gate assembly (53) (FIG. 8), comprising the D.C. gear motor (52), the stationary rollers (54), clutched bearings (55) and a timing belt (62), is provided for dynamic advancement of the stationary rollers (54). This feature enables automatically advancing the singulator (34). The D.C. gear motor (52) is mounted so that it moves with the stationary rollers (54). In this way there remains a tight link between the D.C. gear motor (52) and stationary rollers (54) via the timing belt (62), minimizing and optimally eliminating a need for belt tensioning that could cause inaccurate drive transfer to the stationary rollers (54). The stationary rollers (54) are operable in conjunction with the feed belts (26) for sheet separation. There is substantially constant contact between these two surfaces both during paper feeding and while idle. The friction caused by the paper and feed belt (26) travel causes wear to the stationary rollers (54) surfaces. This wear tends to increase a gap (63) (FIG. 4) between the stationary rollers (54) and feed belts (26), potentially causing multiple pages to be misfed simultaneously, which can result in feeding errors. The automatic advancement feature automatically makes adjustment to any gap (63), whereby the stationary rollers (54) are automatically advanced under CPU control for a preset degree of rotation at a predetermined page count, so to minimize wear around the rollers. To minimize, and optimally eliminate possibility for forward rotation of the stationary rollers (54) as the paper is transferred through the singulator (34), the clutch bearings (55) are provided for the stationary rollers (54). This also reduces, and optimally eliminates, excessive torque on the gear motor (52). The stationary rollers (54) are adjusted via the two spring loaded tension adjustments (56). These adjustments give the singulator (34) a horizontal balance in relationship to the feed belts (26). This minimizes variances in paper skew.

A tilt back feature is disclosed (FIGS. 6, 17 and 18) that allows the feeder (50) to be tilted away from the transport (31) area for error recovery, adjustments, servicing and replacement of the singulator assembly (34). In the tilt back embodiment of the disclosure the feeder (50) is physically mounted to the transport (31) via two hinge points (57) allowing access to the transport area (31). This feature enables the feeder (50) to be lifted with a loaded stack of paper and facilitated by way of two gas springs (58) located within the feeder (50) generally at behind vertical deck (21)(FIG. 13) calibrated to be effective over a range from fully loaded to empty. By means of the positioning side guides (22 and 29), spring loaded guides (59) and transport ramps (60), and transport feeder input (49), the feeder (50) can be returned to its home position (FIG. 5) without disturbing the original set up conditions of the paper stack.

An upper edge guide assembly (FIG. 7) is disclosed and comprises two telescoping positioning brackets (64) supporting a plurality of support wedges (33) for retaining the paper stack (36) in a vertical position. The two telescoping positioning brackets (64) are mounted to the vertical deck (21) via engagement to one of the rods (65) of a vertically adjustable mounting assembly (20). The telescoping positioning brackets (64) are used to horizontally adjust the support wedges (33) having sheet edge-contacting arcing wedge-like surfaces 33', which mount to the telescoping positioning brackets (64) via a common mounting shaft (65'). The support wedges (33) are independently mounted and are positional for adjustment of the arcing surfaces 33' to the paper stack (36). The vertical mounting assembly (20) provides, in the exemplary embodiment, two mounting positions (rods (65')) for convenient relocation of the support wedges (33) and telescoping positioning brackets (33 and 64) for alternate use with, for example, 11" and 14" documents. Actual separation and paper stack support are accomplished via two flexible spring like fingers (66 and 67) mounted directly to each support wedge (33) adjacent the bottom of wedge-like surfaces (33'). The finger (66) is a primary finger and is semi-flexible in order to hold back the paper stack (36) and the finger (67) is a secondary finger and is more flexible creating minimal pressure on the lead document (40) while keeping it captured. The weight of the paper stack (36) is mainly supported by the surface (33') and sheets close to the front of the stack (36) are supported by the primary finger (66) on each support wedge. As each paper (sheet) is drawn into the singulator (34), the next page (sheet) in the stack is pulled down and under the primary finger (66) until it rests between the paper stack (36) and the secondary finger (67). By means of pivoting the support wedges (33) and thereby the surfaces 33' into or away from the paper stack (36), the amount of drag can be minimized. At that point the lead document (sheet) (40) is captured between the paper stack (36) and the secondary flexible finger (67) ready to be fed to the singulator (34). This process achieves separating the next page to be fed and releasing a majority of the drag or friction caused by the weight of the paper stack (36) prior to being driven or drawn into the singulator (34) by the feed belts (26).

The input tray option (at 51) allows the operator to automatically process re-work pieces. By putting the high capacity sheet feeder in a manual mode the operator can hand feed documents in the tray and process through the inserter. The alternate of a low volume feeder attachment allows for accumulating small amounts of reworked documents to be loaded and automatically fed to the staging area of the high capacity sheet feeder (50). The sheet feeder (50) can accept other high capacity sheet feeders in tandem. Each feeder would process documents and transport to the next up-stream feeder. The pages can be processed separately or combined with other tandem feeders outputs for merging and matching functions.

A continuous input device, such as a universal continuous forms processor, can be connected to the input of the sheet feeder (50) as well. This would allow for combinations of continuous form documents to be combined with the output of the high capacity sheet feeder (50) for merging and matching functions.

Another alternative would permit sheets stacked and fed through and just folded as separate sheets. The sheets fed would be controlled by the read marks information and would be grouped and folded together.

Yet another alternative use would involve feeding sheets to be manually handled after folding. Keeping the inserter running would enable processing through the inserter but take advantage of automatically fed sheets.

Both variations can be run in unison with each other or selected to run independently. This provides for an economical document processing solution. A wide variety of tasks can be performed by a single system as disclosed.

While the concepts of the present disclosure have been illustrated and described in detail in the drawings and foregoing description, such an illustration and description is to be considered as exemplary and not restrictive in character, it being understood that only the illustrative embodiments have been shown and described and that all changes and modifications that come within the spirit of the disclosure are desired to be protected.

There are a plurality of advantages that may be inferred from the present disclosure arising from the various features of the apparatus, systems, and methods described herein. It will be noted that alternative embodiments of each of the apparatus, systems, and methods of the present disclosure may not include all of the features described yet still benefit from at least some of the inferred advantages of such features. those of ordinary skill in the art may readily devise their own implementations of an apparatus, system, and method that incorporate one or more of the features of the present disclosure and fall within the spirit and scope of the invention as defined by the appended claims.

What is claimed is:

1. A sheet feeding apparatus comprising:

a sheet feeder having a feed table for maintaining edgewise thereon a stack of sheets, the sheet feeder including stack advancing creeper belts for advancing the stack toward a feeding end thereof, upper edge paper guides for maintaining upper edges of advancing sheets in the stack and separating advancing sheets thereof so that the lead sheet is maintained at minimized pressure, a singulator apparatus drawing sequential lead sheets from the stack through a singulator aperture thereof, said creeper belts and singulator apparatus being synchronously driven in a sheet advancing direction and in a reverse direction, and a controlled sheet path gap assembly receiving sheets from the singulator apparatus including a plurality of transport ramps for directing sheets through a controlled gap;

a transport receiving sheets from said controlled gap for transporting sheets to a downstream device or holding sheets to form a set before transporting to a downstream device, said transport including a second sheet receiving input independent of receipt from said controlled sheet path gap assembly for inputting thereat sheets from one or more additional sheet feeding devices.

* * * * *